US006489835B1

(12) United States Patent
Yu et al.

(10) Patent No.: US 6,489,835 B1
(45) Date of Patent: Dec. 3, 2002

(54) LOW VOLTAGE BANDGAP REFERENCE CIRCUIT

(75) Inventors: Quan Yu, Sunnyvale, CA (US); Edwin Chan, San Jose, CA (US)

(73) Assignee: Lattice Semiconductor Corporation, Hillsboro, OR (US)

( * ) Notice: Subject to any disclaimer, the term of this patent is extended or adjusted under 35 U.S.C. 154(b) by 0 days.

(21) Appl. No.: 09/941,454

(22) Filed: Aug. 28, 2001

(51) Int. Cl.[7] ..... G05F 1/10; G05F 3/02
(52) U.S. Cl. ..... 327/539; 323/313
(58) Field of Search ..... 327/538, 539, 327/540, 541; 323/312, 313, 315, 316

(56) References Cited

U.S. PATENT DOCUMENTS 5,512,817 A * 4/1996 Nagaraj ..... 323/316

OTHER PUBLICATIONS

Karel E. Kuijk, "A Precision Reference Voltage Source", IEEE Journal of Solid–State Circuits, vol. SC–8, No. 3, (Jun. 1973) pp. 222–226.

Gerard C.M. Meijer, et al., "A New Curvature–Corrected Bandgap Reference", IEEE Journal of Solid–State Circuits, vol. SC–17, No. 6, (Dec. 1982) pp. 1139–1143.

Bang–Sup Song, "A Precision Curvature–Compensated CMOS Bandgap Reference", IEEE Journal of Solid State Circuits, vol. SC–18, No. 6, (Dec. 1983) pp. 634–643.

Germano Nicollini, et al., "A CMOS Bandgap Reference for Differential Signal Processing", IEEE Journal of Solid–State Circuits, vol. 26, No. 1, (Jan. 1991) pp. 41–50.

Ian A. Young, et al., "A PLL Clock Generator with 5 to 110 MHz of Lock Range for Microprocessors", IEEE Journal of Solid–State Circuits, vol. 27, No. 11, (Nov. 1992) pp. 1599–1606.

* cited by examiner

*Primary Examiner*—Terry D. Cunningham
*Assistant Examiner*—Quan Tra

(57) ABSTRACT

A bandgap reference circuit that operates with a voltage supply that can be lass than 1 volt and that has one stable, non-zero current operating point. The core has a current generator embedded within it and includes one operational amplifier that provides a self-regulated voltage for several transistors used in the circuit

7 Claims, 2 Drawing Sheets

LOW VOLTAGE BANDGAP REFERENCE CIRCUIT

FIELD OF THE INVENTION

This invention relates to a bandgap reference circuit that operates with low voltage.

BACKGROUND OF THE INVENTION

Bandgap reference voltage generators are used in DRAMs, flash memories and analog devices and are required to provide stable voltages over a wide range of voltage supplies and temperatures. Increasing demand for use of lower supply voltages will soon push the supply voltage below 1.25 Volts, the standard for which bandgap reference circuits are now designed. A conventional bandgap reference circuit includes three sections: a core where an input voltage is developed and conditioned, a bandgap generator, and a current generator. This circuit must operate with a supply voltage that is at least a few hundred millivolts (mV) above the desired bandgap voltage (≈1.25 Volts).

FIG. 1 illustrates a conventional bandgap reference circuit 10 having a core region 11, a bandgap generator region 21 and a current generator region 31. The core region 11 includes two PMOS transistors, 12 and 13, connected at their sources to a voltage supply 14 and connected at their drains to negative and positive input terminals of a first operational amplifier 15 whose output terminal is connected to the gates of the first and second transistors, 12 and 13. First and second matched bipolar transistors, 16 and 17, have collectors and bases connected to ground. The emitters of the first and second bipolar transistors, 16 and 17, are connected to the drain of the first PMOS transistor 12 and through a first resistor 18 to the drain of the second PMOS transistor 13, respectively.

The bandgap voltage generator region 21 includes a third PMOS transistor 22, with source connected to the voltage supply 14 and gate connected to the output terminal of the op amp 15. The drain of the third PMOS transistor 22 is connected through a second resistor 23 to the emitter of a third bipolar transistor 24, whose collector and base are grounded.

The current generator region 31 includes a fourth PMOS transistor 32 with sources connected to the voltage supply 14 and gate connected to an output terminal of a second op amp 34. A negative input terminal of the second op amp 34 is connected to the drain of the third PMOS transistor. A positive input of the second op amp 34 and the drain of the fourth transistor 32 are connected through a third resistor 35 to ground. The fifth transistor 33 serves as a source for a current $I_{out}$. This device requires two operational amplifiers, at least five PMOS transistors, and a supply voltage that is at least about 400 mV above a target bandgap reference voltage.

If the supply voltage is decreased to 1.2 V and below, the standard bandgap voltage of 1.25 V can no longer be maintained. What is needed is a bandgap reference circuit that allows operation with supply voltages as low as about 1 V, or preferably lower, and that has no more than one or two stable operating points.

SUMMARY OF THE INVENTION

These needs are met by the invention, which provides a bandgap reference circuit that operates with a supply voltage of about 1V and that has one stable operating point, unless all currents in the system are substantially zero initially. The invention uses only one operational amplifier, four PMOS transistors and one additional current path to ground in one embodiment. The core includes a current generator embedded therein.

DESCRIPTION OF THE BEST MODE OF THE INVENTION

Figure 2:
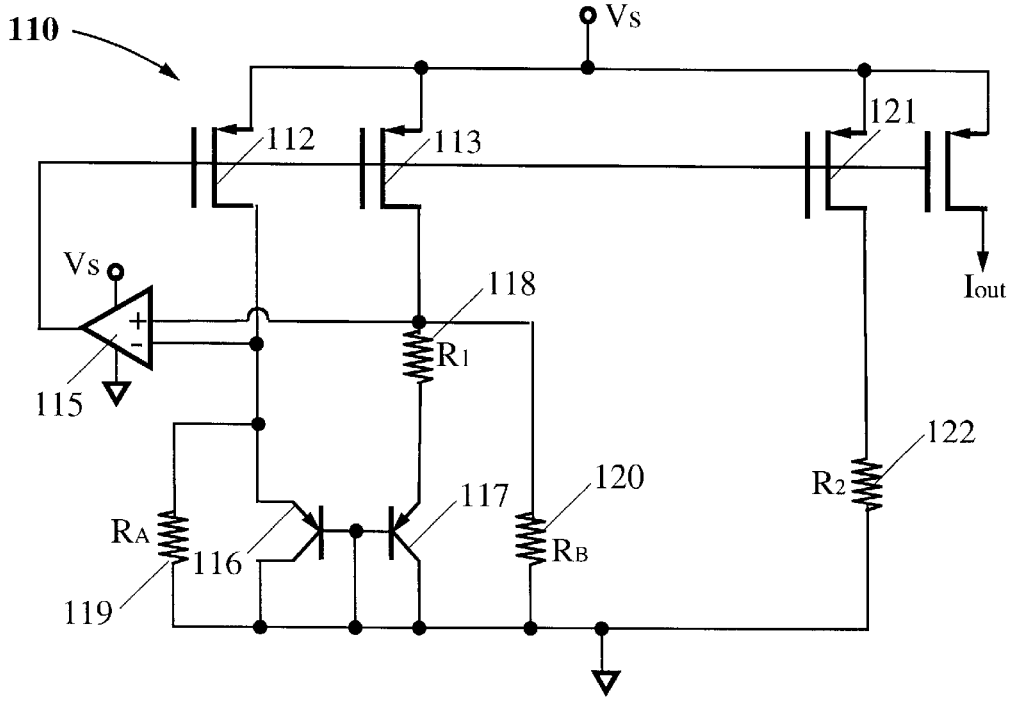
FIG. 2 (Prior Art)

Banba et al, in "A CMOS Bandgap Reference Circuit with Sub-1-V Operation", I.E.E.E. Jour. Solid State Circuits, vol. 34 (1999) pp. 670–674 discloses a bandgap reference circuit that can operate at supply voltages down to about 1 V by generating a scaled bandgap voltage. The circuit, shown in FIG. 2, provides two additional current paths, through third and fourth resistors (RA and (RB), from the drains of the first and second PMOS transistors, 112 and 113, to ground.

However, the additional circuit paths provided by the third and fourth resistors, RA and RB, allow more than one operating point, especially when the drain voltages of the first and second PMOS transistors, 112 and 113, drop below a value equivalent to one diode turn-on voltage $\Delta V_{be}$ (i.e., when the two bipolar devices are turned off). Existence of more than one operating point makes the start-up circuit very complex, or requires an additional circuit to guarantee achievement of a proper operating point. Without such a circuit, the risk of having an undesired operating point is high.

Figure 3:
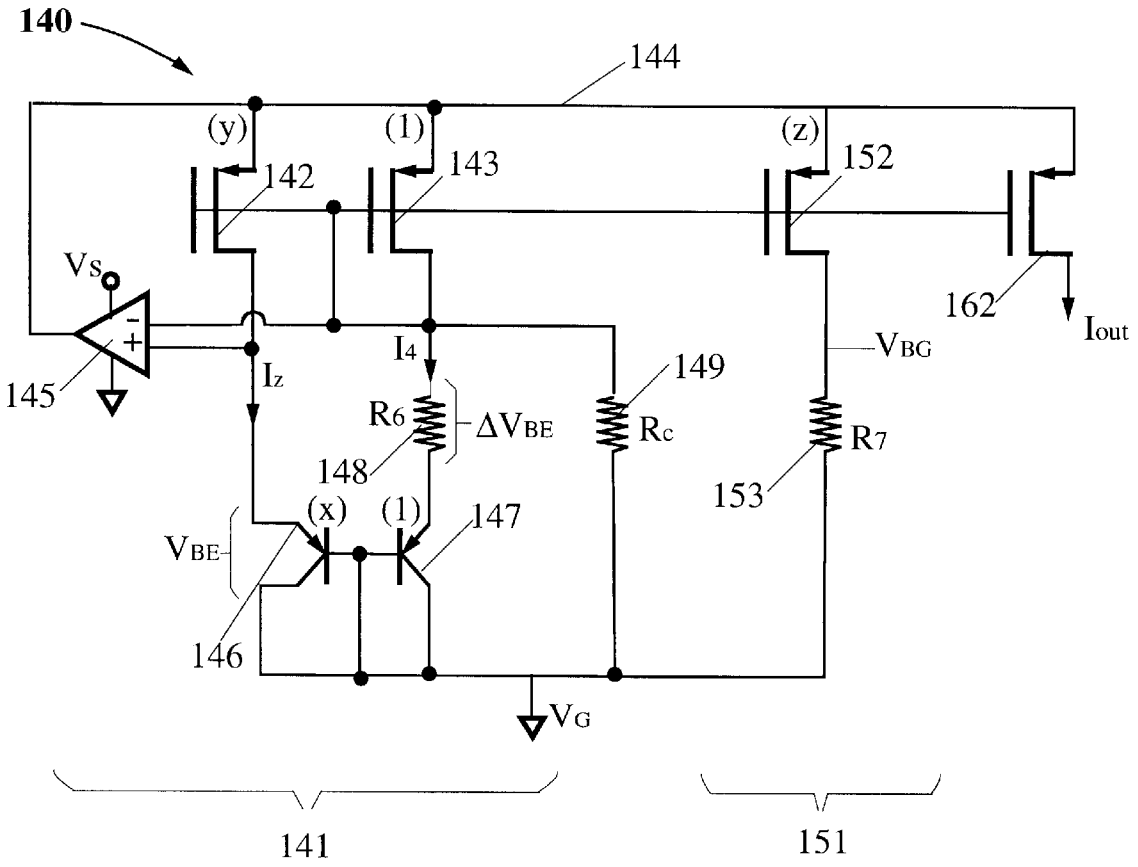
FIG. 3 illustrates a bandgap reference circuit according to the invention.

FIG. 3 illustrates a bandgap reference circuit 140 constructed according to the invention, including a core 141 with current generator embedded and a bandgap reference generator 151. The core region 141 includes first and second PMOS transistors, 142 and 143, connected at their sources to a self-regulated voltage 144 and connected at their drains to a positive terminal and to a negative input terminal, respectively, of an operational amplifier 145 whose output terminal provides the self-regulated voltage 144. A specified voltage supply $V_s$ is connected only to the operational amplifier 145. First and second matched pnp bipolar transistors, 146 and 147, have collectors and bases connected to ground. The two diode-connected pnp devices, 146 and 147, may also be replaced by two diode-connected npn devices. The emitter of the first bipolar transistor 146 is connected to the drain of the first PMOS transistor 142 and to a positive input terminal of the op amp 145. The emitter of the second bipolar transistor 147 is connected through a first resistor 148 to the drain of the second PMOS transistor 143 and to the negative input terminal of the op amp 145, and through a second resistor 149 to ground.

The bandgap voltage generator region 151 includes a third PMOS transistor 152, with source connected to the regulated voltage supply 144 and gate connected to the gates of the first and second PMOS transistors, 142 and 143. The drain of the third PMOS transistor 152 is connected through a third resistor 153 to ground.

The circuit 140 includes a fourth PMOS transistor 162 with source connected to the regulated voltage supply 144 and gate connected to the gates of the first, second and third PMOS transistors, 142, 143 and 152. The fourth transistor 162 serves as a source for a controllable current $I_{out}$.

The width-to-length (W/L) ratios for the first, second, third and fourth PMOS transistors and for the first and second bipolar transistors are the following first PMOS: second PMOS ratio y:1 (e.g., 2:1)

third PMOS: second PMOS ratio z:1 (e.g., 4:1)

first pnp: second pnp ratio: x:1 (e.g., 1:8)

Figure 1:
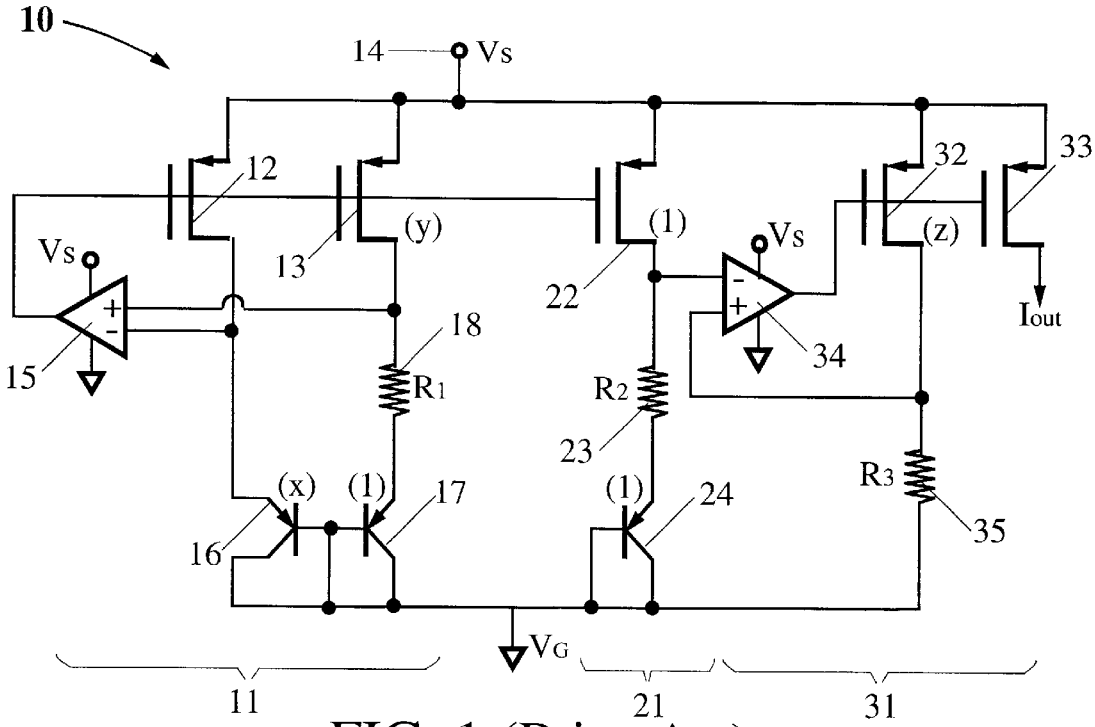
FIG. 1 (Prior Art)
FIGS. 1 and 2 illustrate conventional bandgap reference circuits.

The configuration shown in FIG. 3 differs from the conventional circuit (shown in FIG. 1) in several ways. First, only one operation amplifier, 145, is required in FIG. 3. Second, the circuit can operate at supply voltages below 1 V, by generating a scaled bandgap voltage. Third, only four PMOS transistors are required. Fourth, the gates of two PMOS transistors are tied to an input terminal of the op amp, not to its output terminal. Fifth, only two bipolar transistors are required.

Sixth, only one resistor (149 in FIG. 3) is added to provide an additional current path from the drain of the second PMOS transistor 143 to ground, rather than providing two such resistors, as in the circuit in FIG. 2. The configuration of FIG. 3 forces the drain voltages of the PMOS transistors (142 and 143 in FIG. 3) to have higher values than the diode turn-on voltage $V_{be}$ and allows the system to avoid all operating points for which the drain voltages are below $V_{be}$. Consequently, only one non-zero current operating point is available.

Seventh, a current generator is embedded in the core, rather than being physically separated from the core. Eighth, sources of the four PMOS transistors receive a self-regulated voltage rather than a voltage from a conventional power supply, through use of a feedback system that helps increase the power supply rejection ratio (PSRR) for the system.

These differences contribute to the following distinguishing features of the bandgap reference circuit shown in FIG. 3: (1) the required supply voltage can be below 1 V and (2) only one non-zero stable operating point exists, corresponding to a non-zero initial current, and the system will move to this point after power-up.

Notations used for circuit parameters are indicated in FIG. 3. The following equations govern operation of the bandgap reference circuit shown in FIG. 3:

$$I_4 = (I_Z/y) - (V_{be0}/R_C),$$

$$\Delta V_{be} = V_t \ln(I_Z/xI_4),$$

$$= -V_t \ln\{x\{(1/y) - (V_{be0}/I_Z R_C)\}\},$$

-continued $$V_{BG} = (zR_7/R_C)\{V_{be0} - V_t(R_C/R6)\ln\{x\{(1/y) - (V_{be0}/I_Z R_C)\}\}.$$

What is claimed is:

1. A system for providing a bandgap reference voltage, the system comprising:

first and second PMOS transistors, connected at their gates to a drain of the second PMOS transistor and to a negative input terminal of an operational amplifier having a selected supply voltage, with a drain of the first PMOS transistor connected to a positive input terminal of the amplifier;

first and second bipolar transistors, with bases and collectors connected to ground, with the first and second bipolar emitters connected to the first PMOS transistor drain and through a first resistor to the second PMOS transistor drain, respectively;

a second resistor connected between the drain of the second PMOS transistor and ground;

a third PMOS transistor having a drain connected through a third resistor to ground; and a fourth PMOS transistor, serving as a current source, having a gate connected to the gates of the first, second and third PMOS transistors, and having a source connected to sources of the first, second and third PMOS transistors and to an output terminal of the amplifier.

2. The system of claim 1, wherein said first and second bipolar transistors are substantially matched.

3. The system of claim 1, wherein said first and second bipolar transistors have a selected emitter area ratio of x:1, wherein $x \neq 1$.

4. The system of claim 1, wherein said first and second bipolar transistors have a selected emitter area ratio of x:1, wherein x=1.

5. The system of claim 1, wherein said operational amplifier output terminal provides a self-regulated voltage.

6. The system of claim 1, wherein said supply voltage is less than one volt.

7. The system of claim 1, having at most one stable, non-zero current operating point.

* * * * *